US005117952A

United States Patent [19]

Suh

[11] Patent Number: 5,117,952

[45] Date of Patent: Jun. 2, 1992

[54] PORTABLE SAFETY BAG

[76] Inventor: Young H. Suh, 506-704 Shinsigaji Apt., Mok-dong 912, Yangchun-ku, Seoul, Rep. of Korea

[21] Appl. No.: 635,477

[22] Filed: Dec. 28, 1990

[51] Int. Cl.[5] ..... A45C 13/36; B65D 85/38

[52] U.S. Cl. ..... 190/127; 206/316.2; 206/523

[58] Field of Search ..... 150/127-130; 190/110, 109, 124-127, 103; 206/316.1, 316.2, 320, 521, 523

[56] References Cited

U.S. PATENT DOCUMENTS

| | | | |
|---|---|---|---|
| 2,471,612 | 5/1949 | Freeman | 190/126 |
| 2,574,089 | 11/1951 | Cochran | 190/125 |
| 4,403,638 | 9/1983 | Baun | 206/316.2 |
| 4,437,549 | 3/1984 | Gibbs | 190/109 |
| 4,610,286 | 9/1986 | Cyr | 206/316.2 |
| 4,733,806 | 3/1988 | Sloop | 206/316.2 |
| 4,921,151 | 5/1990 | Duvall | 190/125 X |
| 5,010,988 | 4/1991 | Brown | 190/127 X |

FOREIGN PATENT DOCUMENTS

| | | | |
|---|---|---|---|
| WO84/01093 | 3/1984 | World Int. Prop. O. | 190/127 |

*Primary Examiner*—Bryon P. Gehman
*Attorney, Agent, or Firm*—Hecker & Harriman

[57] ABSTRACT

The present invention relates to portable bag for storing and carrying cameras, camera accessories, measuring instruments, cosmetics or any other fragile, impact-sensitive items. The bag of the present invention includes foam sheets inserted between the inner and outer layers of the front, back and side pieces, a cushioning cover on the bottom plate, a lid, an outer pocket, a shoulder strap and adjustable inner partitions; and provides a highly shock absorbent bag which can safely store and carry impact-sensitive articles. In addition, the components of the portable bag are manufactured and assembled in standardized fashion which provide a high quality product.

5 Claims, 4 Drawing Sheets

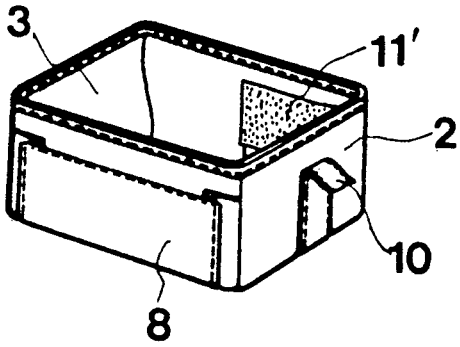
FIG. 5A
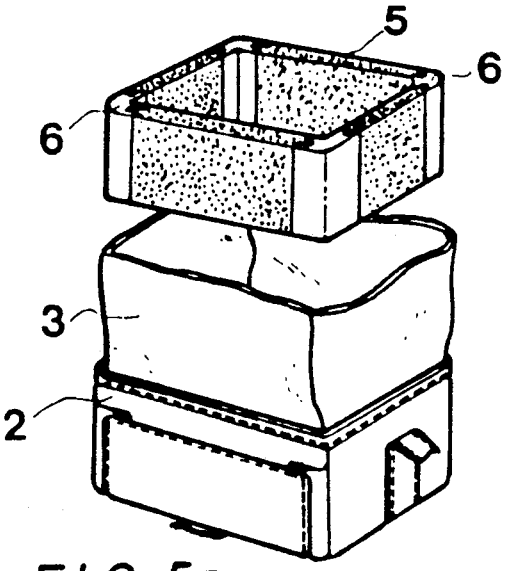
FIG. 5B
FIG. 5C
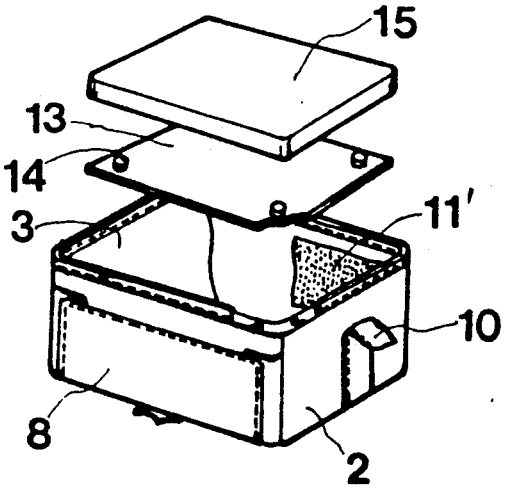
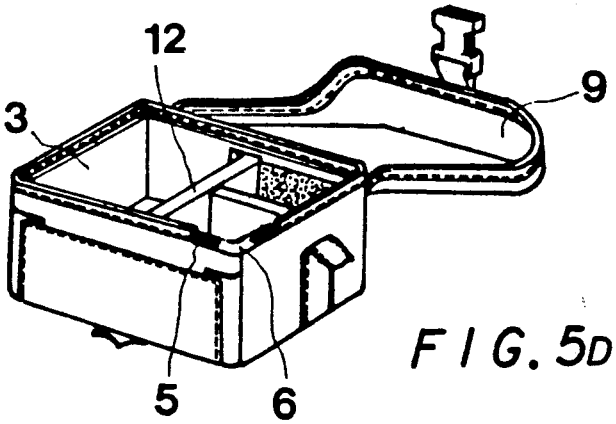
FIG. 5D

PORTABLE SAFETY BAG

BACKGROUND OF THE PRESENT INVENTION

1. Field of the Invention

The present invention relates to a portable bag in which fragile articles such as cameras and camera components can be stored and carried in a safe manner, and particularly, to a portable bag in which the articles stored inside are protected from external impact.

2. Background Art

Generally, portable bags for storing and carrying expensive and impact-sensitive articles such as cameras and measuring instruments are rectangular and hexahedral in shape. Inside of each panel, a sponge sheet is inserted such that the sponge sheet serves to maintain the rectangular and hexahedral shape of the portable bag, as well as to protect the articles stored inside of the bag from external impact.

However, it is difficult to manufacture portable bags having sponge sheets of the necessary strength and elasticity without encountering many disadvantages. For example, when the outer and inner layers are sewn together after inserting sponge sheets between the outer layers and the inner layers, even a heavy duty sewing machine is overworked due to the thickness and strength of the sponge sheet. Consequently, the quality of the sewing becomes unacceptable, in that it is very difficult to properly finish the edge portions or sew the seams in a straight line. Thus, the aesthetic appearance of the bag is degraded and the walls of the bag become twisted.

When the walls in which the sponge sheets are inserted are joined together, the inside of the bag must be sewn up. Therefore, the bag must be sewn with the inside out, while the finishing sewing is done with the bag right side out. In this case, turning the bag from the inside to the right side out is not easy because of the resiliency and strength of the sponge. Thus, the manufacturing steps, i.e. insertion of the sponge sheets, the sewing, turning the bag inside and right side out and the finishing work are all difficult tasks, resulting in an excessive expenditure of time and labor, thereby increasing the overall manufacturing cost of the bag.

In some conventional bags, sponge sheets are selected having the necessary strength (other than the ordinary flexible ones); however, in such a case, if a great external impact is applied, the sponge sheets are deformed, thereby making it impossible to effectively protect the stored articles. Such problems are not only attributed to the insufficiency of the strength of the sponge sheets, but also to the fact that there is no rigid member between the outer and inner layers.

SUMMARY OF THE PRESENT INVENTION

It is the object of the present invention to overcome the above described disadvantages found in conventional portable bags.

In particular, it is the object of the present invention to provide a portable bag in which the components of the bag are standardized in size so that the manufacture and overall functionality of the bag can be improved.

To achieve the above object, the portable bag of the present invention comprises an outer side layer provided with a pocket, a shoulder strap, and a lid; an outer bottom layer forming the bottom of the bag which is sewn together with the outer side layer; an inner side layer sewn to the upper edge of the outer side layer; a side frame consisting of a combination of molded supporting members and standardized sponge sheets inserted between the outer side layer and inner side layer. The bag further includes a bottom plate and cushioning plate which is laid on the inner bottom surface of the bag and partitioning walls to divide the interior of the bag. The partitioning walls are provided with a suitable fastening means, such as magic tape.

The manufacturing process of the portable bag of the present invention consists of cutting the inner side layers and outer side layer from a raw material into a standardized, regular pattern. Magic tape is attached to the inside portion of the inner side layer, and the upper edges of the outer side layer and inner side layer. The lower edge of the outer side layer and the edge of the outer bottom layer are sewn together. The side wall frame is assembled by inserting a reinforced side wall frame into the slots of the molded corner of the reinforcing supporting members. The side wall frame is then inserted between the inner layer and outer layer. The bottom plate is installed by placing the bottom plate on the outer bottom layer so as to arrange the edges of the inner side layer, and fixing the bottom plate to the outer bottom layer with fastening means, such as rivets or the like. The interior of the bag has cushioning covers on the bottom plate, and is divided by partitioning walls. A cover is attached to an edge of the outer side layer.

BRIEF DESCRIPTION OF THE DRAWINGS

The above object and other advantages of the present invention will become more apparent in the detailed description of the invention with reference to the attached drawings as described below.

FIGS. 5A, 5B, 5C and 5D are perspective views showing the manufacturing process of the portable bag of the present invention.

DETAILED DESCRIPTION OF THE INVENTION

Figure 1:
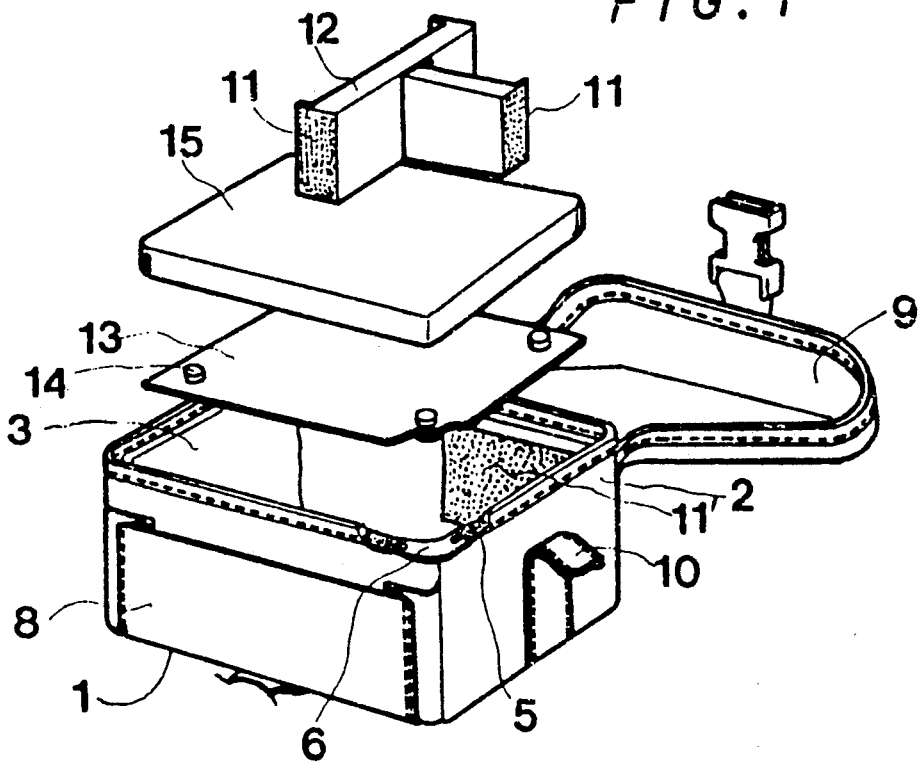
FIG. 1 is an exploded perspective view of the portable bag of the present invention.
Figure 2:
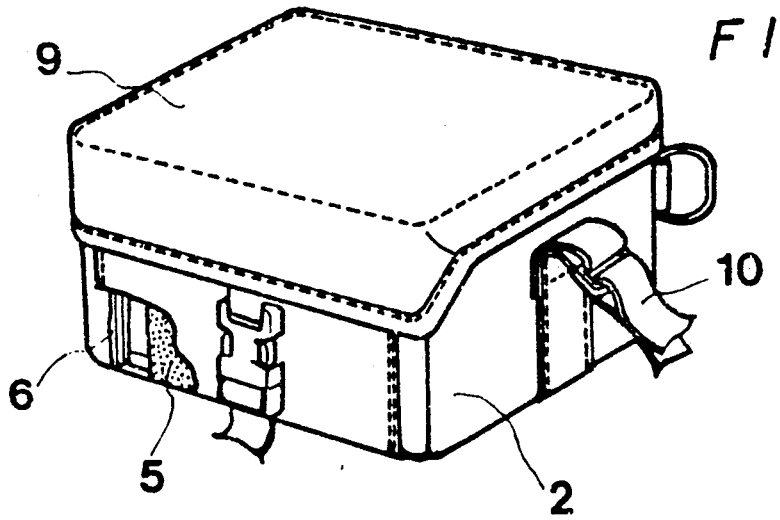
FIG. 2 is a perspective view of the assembled portable bag of FIG. 1.
Figure 6A:
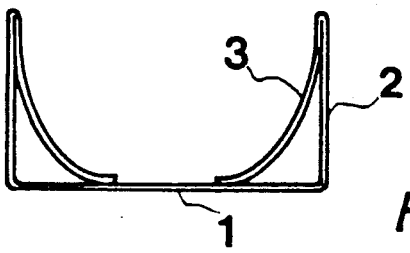
FIGS. 6A, 6B and 6C are sectional views showing the assembly steps for the portable bag of the present invention.
Figure 6B:
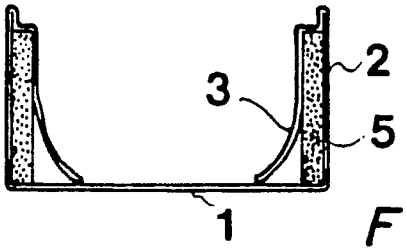

As shown in FIGS. 1 and 6A, the basic structure of the portable bag according to the present invention comprises a rectangular outer bottom layer 1, an outer side layer 2 vertically sewn to the edges of the outer bottom layer 1, and an inner side layer 3 sewn to the upper edge of the outer side layer 2 and extending down into the interior of the bag, thereby forming a rectangular basket. As shown in FIG. 6A, the inner side layer 3 is longer than the outer side layer 2 and is accommodated within the bag.

Figure 3A:
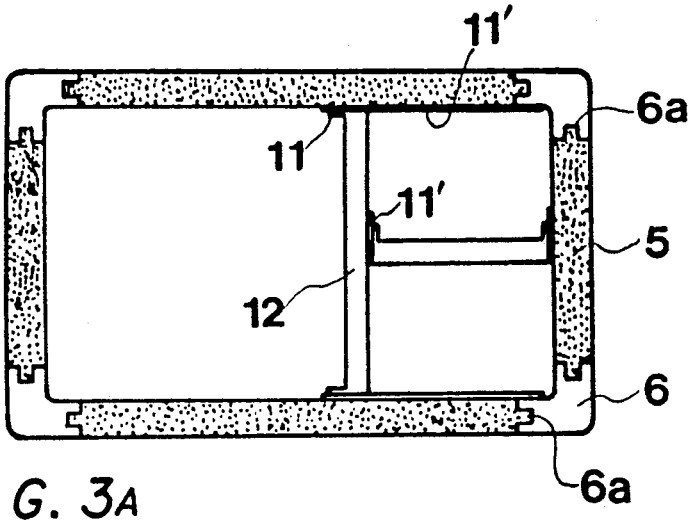
FIG. 3 is a plan view showing the interior of the portable bag of FIG. 1.
Figure 4A:
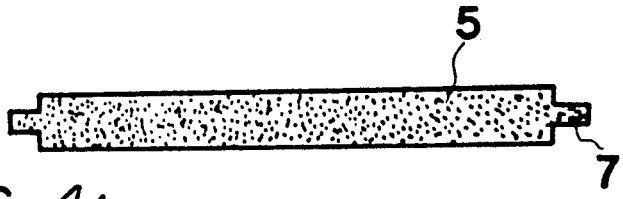
FIGS. 4A and 4B are first and second embodiments, respectively, of the sponge sheet used in the portable bag of the present invention.
Figure 4B:
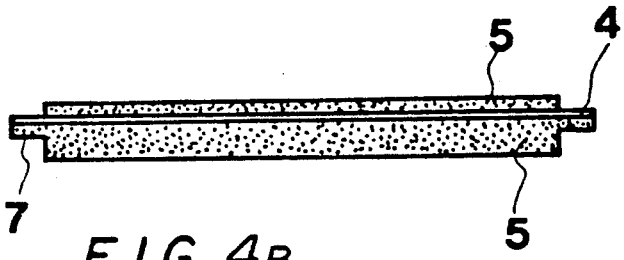

As shown in FIGS. 3 and 4, a sponge sheet 5 and a corner reinforcing supporting members 6 are inserted between the inner side layer 3 and outer side layer 2 to form a reinforcing side wall. The sponge sheet 5 can be integrally formed (as shown in the first embodiment of FIG. 4A), or it can be reinforced with a reinforcing plate 4 (as shown in the second embodiment of FIG. 4B).

The corner reinforcing supporting member 6 which is disposed at each of the four corners of the bag and between the inner side layer 3 and outer side layer 2 is connected to the sponge sheet 5 so that compressed stepped portions 7 are formed along the opposite edges of the sponge sheet 5 by applying a microwave heat. The compressed portions 7 are then inserted into the insertion slots 6*a* of the corner reinforcing supporting member 6.

An auxiliary pocket 8 is sewn on the front face of the outer side layer 2. A lid 9, in which a sponge sheet is inserted, is attached to the rear upper edge of the outer side layer 2 such that the lid 9 pivots around the joined portion, thereby allowing the bag to be opened and closed.

A shoulder strap 10 is attached to the outer side layer 2 so that the bag can be carried on the shoulder of the user. The interior of the bag is divided with partitioning walls 12 as shown in FIGS. 1 and 3. A fastening means, such as velcro or magic tape 11 attached to the partitioning walls 12 allows the partitioning walls 12 to be detachably attached the inner side layer 3. Thus, the partitions 12 can be arbitrarily repositioned and adjusted to fit the particular articles to be stored.

Figure 6C:
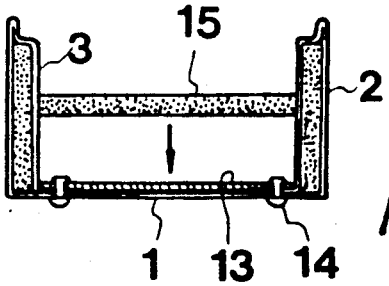

A bottom plate is installed on the bottom of the interior of the bag, such that the bottom plate is fitted to the inner edges of the bottom outer bottom layer 1 and the inner side layer 3. Protuberances 14 are installed at the corners of the bottom plate 13. These protuberances 14 pass through the bottom plate 13, the inner side layer 3 and the outer bottom layer 1 as shown in FIG. 6C.

The manufacturing process of the portable bag of the present invention will now be described.

Raw material is cut into the pattern of the inner side layer 3 and outer side layer 2. Magic tape 11 is then attached to the inner side layer 3 and an auxiliary pocket 8, A shoulder strap 10 is attached to the front and sides of the outer side layer 2. The outer bottom layer 1 and the outer side layer 2 are sewn together so that the bottom layer 1 and outer side layer 2 are perpendicular to each other. The inner side layer 3 and the outer side layer 2 are sewn together so that the inner side layer 3 extends into the interior of the bag.

A sponge sheet 5 is then inserted into the molded corner reinforcing supporting member 6 to form the side wall frame of FIG. 5B. This side wall frame is inserted between the inner side layer 3 and outer side layer 2. The bottom plate 13 is positioned to that it is seated on both the outer bottom layer 1 and the edges of the inner side layer 3 accommodated within the bag. The bottom plate 13 is then fixed to the outer bottom layer 1 by the protuberances 14 or by rivets. A cushioning cover 15 is placed on the bottom plate 13, and the interior of the bag is sectioned by partitioning walls 12.

As the final step, the lid 9 is attached to the upper rear edge of the outer side layer 2, thus, completing the manufacturing process. The portable bag thus produced in accordance with the above-described manufacturing method has the shape and the structure shown in FIGS. 5A to 5D and FIGS. 6A to 6C.

In the portable bag of the present invention as described above, the auxiliary pocket 8 can be sewn not only on the front face of the outer side layer 2, but also on the opposite side faces and the rear face. The interior of the bag can be restructured by means of the partitioning walls 12 by merely changing their position.

The shape and size of the bag can be large or small and can be made in a square rather than rectangular form.

Further, the portable bag of the present invention is not limited to storing and carrying cameras and measuring instruments, but may also be used to carry cosmetic products, precious metals and stones, or any other delicate, fragile and/or expensive items.

Since the assembly of the portable bag of the present invention is very simple, a user can procure semi-finished pieces of the bag, such as the inner side layer 3 and outer side layer 2 with the lid 9 attached, the sponge sheet 5, the partitioning walls 12 and the like, before assembling these pieces to suit their particular needs. Thus, users can select the size and color which fit their taste and personal preference, while producing a cost efficient product.

The present invention utilizes standardized components and therefore, quality control during the manufacturing process is more effective. In addition, a high quality standardized product is produced. Further, the bag is highly shock absorbent so that cameras and other impact-sensitive articles can be stored and carried safely.

I claim:

1. A portable bag comprising a bottom and lid sewn to an outer side layer, and an auxiliary pocket and a shoulder strap attached on the faces of said outer side layer, so as for a rectangular hexahedral portable bag to be formed, characterized in that:

the portable bag including an outer bottom layer (1) sewn to the edge of an outer side layer (2); an inner side layer (3) sewn to the upper edge of said outer side layer (2); a combination of a sponge sheet (5) and a corner reinforcing supporting member (6) inserted between said inner side and outer side layers (3 and 2); a bottom plate (13) placed on said outer bottom layer (1) and secured to it by means of supporting protuberances (14); a cushion plate (15) placed upon said bottom plate (13); and partitioning walls (12) for partitioning the interior of the portable bag.

2. The portable bag as according to claim 1, wherein stepped compressed edge portions (7) are formed on both edges of said sponge sheet (5) by applying a microwave heat to the edges, so as for said stepped compressed edge portions (7) to be fitted to slots (6*a*) of said corner reinforcing supporting member (6).

3. The portable bag according to claim 2 wherein said sponge sheet (5) is reinforced with a reinforcing plate (4).

4. The portable bag according to claim 1, wherein said inner side layer (3) sewn to said outer side layer (2) is extended down into the interior of the bag, and lower edge portions of said inner side layer are secured by being pressed by said bottom plate (13), and positioned between said bottom plate (13) and said outer bottom layer (1).

5. The portable bag according to claim 1 wherein said bottom plate (13) is placed on said outer bottom layer (1) and secured to it by means of rivets.

* * * * *